United States Patent [19]

Urquhart et al.

[11] Patent Number: 4,812,080

[45] Date of Patent: Mar. 14, 1989

[54] OFFSHORE PLATFORM JACKET AND METHOD OF INSTALLATION

[75] Inventors: Richard G. Urquhart, Dallas; Adel S. Tawfik, Houston, both of Tex.

[73] Assignees: Atlantic Richfield Company, Los Angeles, Calif.; Brown & Root, Inc., Houston, Tex.

[21] Appl. No.: 77,481

[22] Filed: Jul. 24, 1987

[51] Int. Cl.[4] ..... E02B 17/00

[52] U.S. Cl. ..... 405/227; 405/204; 405/224

[58] Field of Search ..... 405/227, 203, 204, 195, 405/205, 206, 207, 208, 224, 225

[56] References Cited

U.S. PATENT DOCUMENTS

| | | | |
|---|---|---|---|
| 4,422,805 | 12/1983 | Sweatman | 405/227 X |
| 4,493,592 | 1/1985 | Knox | 405/227 X |
| 4,558,973 | 12/1985 | Blandford | 405/227 X |
| 4,576,523 | 3/1986 | Smetak | 405/227 |
| 4,679,964 | 7/1987 | Blandford | 405/227 X |
| 4,721,416 | 1/1988 | Gracia | 405/227 |

*Primary Examiner*—Dennis L. Taylor

*Attorney, Agent, or Firm*—Michael E. Martin

[57] ABSTRACT

A jacket for supporting an offshore platform or the like comprises at least one vertical column member, laterally and vertically spaced guide sleeves for piles to be driven into the sea floor and lateral bracing connecting the guide sleeves to the column member. The jacket may be installed with the piles prepositioned extending through the guide sleeves and temporarily secured thereto until the jacket and pile assembly is in position on the sea floor and ready for pile driving. The vertical column member may receive a pile which may include a well casing. A method of installation for the jacket may include drilling a well through the column member after installation of the jacket and securement to the sea floor by the piles which extend through the guide sleeves.

11 Claims, 4 Drawing Sheets

OFFSHORE PLATFORM JACKET AND METHOD OF INSTALLATION

BACKGROUND OF THE INVENTION

1. Field of the Invention

The present invention pertains to a tower or so-called jacket structure and a method of installation for supporting offshore oil and gas operations platforms.

2. Background

A wide variety of offshore support structures have been developed for use in conjunction with the development and production of oil and gas from offshore wells. In water depths up to several hundred feet fixed support structures known as "jackets" have been constructed in the form of self-supporting, skeletal towers, basically comprising three or more vertical column or leg members which are interconnected by suitable bracing. Such towers are typically secured to the sea floor by piling which is driven through the hollow leg members and secured to the leg members before installation of a deck or other structure to be supported by the jacket.

The structural requirements of prior art jackets has been such that in order for the jackets to be self supporting prior to and after installation, that the plural leg members are all made up of relatively large diameter metal pipe, thereby adding to the weight and cost of the jacket structure. The bracing required to support the pipe type leg members is also required to be relatively complex and the overall structure thereby is subject to greater wave loading when installed in the sea. In essence, the construction of prior art jackets is such that the leg members are not efficiently utilized. The jacket structure itself serves primarily as a guide and lateral support for piling which bears the actual vertical load of the deck or other structure to be supported above the surface of the sea.

SUMMARY OF THE INVENTION

The present invention provides an improved jacket or tower structure particuarly adapted for installation on the sea floor for supporting a deck or similar structure above the sea surface. In accordance with an important aspect of the present invention, an offshore platform support jacket is provided which is adapted to receive two or more piles as part of the support structure, which piles are extended through guide sleeves formed at the nodes of the jacket braces and which piles comprise at least some of the column or leg members of the jacket.

In particular, in one preferred configuration of the jacket, a generally vertical column member is provided for receiving a pile or a well casing extending through the column member and into the sea floor. The column member is adapted to support plural guide sleeves by an arrangement of lateral and diagonal bracing and wherein the guide sleeves are adapted to receive elongated piles which are operable to be driven through the sleeves and into the sea floor to form support structure for a platform deck or the like. In effect, the jacket structure comprises lateral bracing for the piles. In this way, the jacket structure is considerably lighter in weight than conventional skeletal frame jacket structures with plural spaced apart column members, wave loading on the jacket is reduced and the cost of manufacturing the jacket is also reduced.

In accordance with another aspect of the present invention, there is provided an improved method of installing an offshore platform support jacket and the like comprising a structure which serves as lateral bracing for platform deck support piles and other column members, such as a well casing. In one preferred method of installation of the jacket, piling is preinstalled through pile guide sleeves on the jacket and each pile is temporarily secured to the sleeves so that the jacket itself in assembly with the piling may be transferred from a barge or similar vessel to a selected position on the sea floor, followed by removal of the temporary connection between the piling and the jacket structure and driving of the piling into its final position for supporting a deck or the like.

Those skilled in the art will recognize further advantages and superior features of the present invention upon reading the detailed description which follows in conjunction with the drawing.

DESCRIPTION OF PREFERRED EMBODIMENTS

Figure 1:
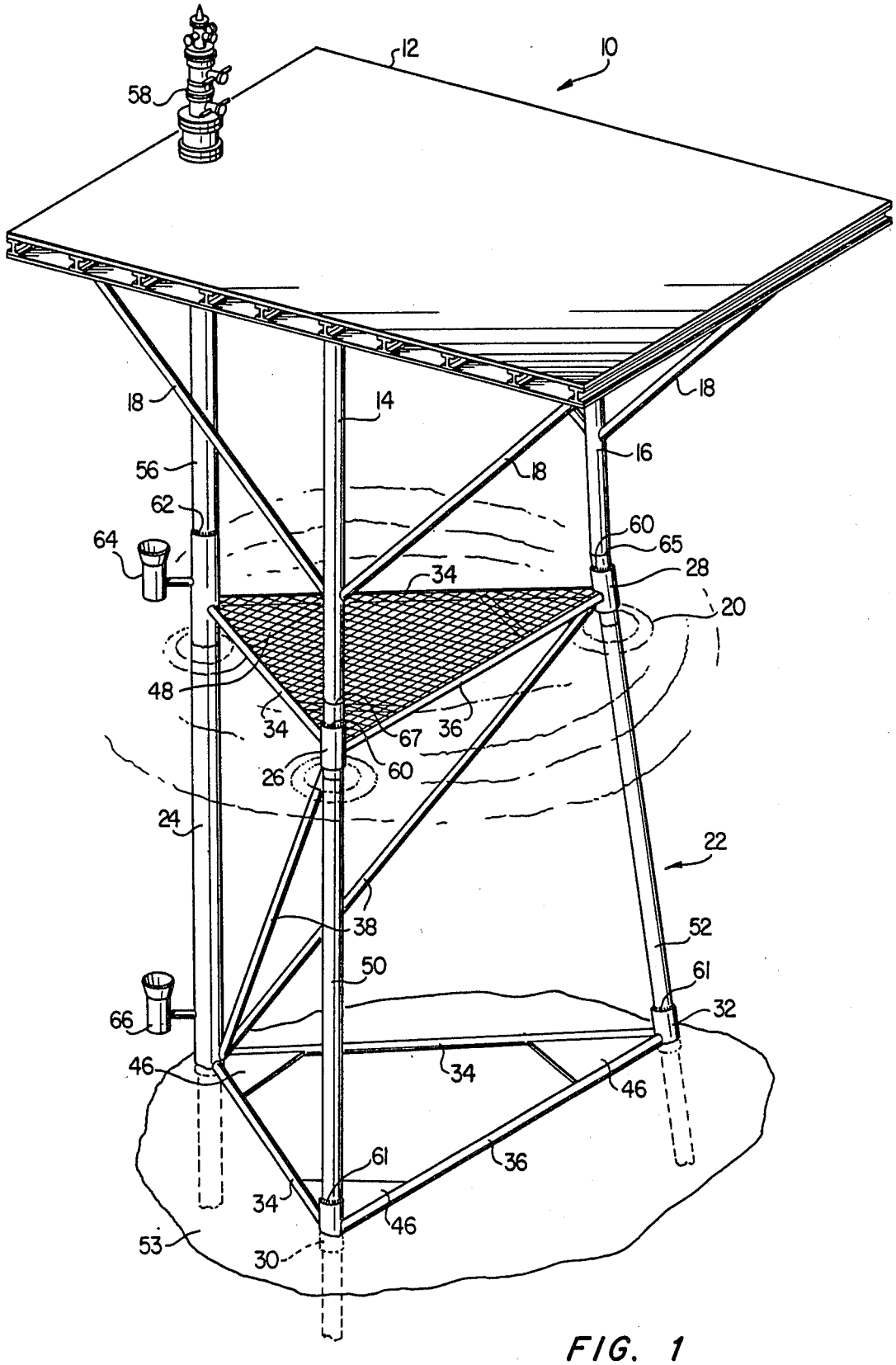
FIG. 1 is a perspective view of an offshore platform, including an improved support structure or jacket in accordance with the present invention.

In the description which follows, like parts are marked throughout the specification and drawing with the same reference numeral, respectively. The drawing figures are not necessarily to scale and certain features of the invention may be shown exaggerated in scale or in somewhat schematic or simplified form in the interest of clarity and conciseness.

Referring to FIG. 1, there is shown a completed installation of an offshore platform utilizing the tower or jacket and method of the present invention. The offshore platform structure is generally designated by the numeral 10 and includes a platform deck 12 having depending support legs 14 and 16 which are suitably braced by diagonal braces 18 depending also from the deck 12. The deck 12 and its depending support legs 14 and 16 are shown in somewhat simplified form and virtually all of the structure normally supported by the deck has been eliminated from the drawing since it forms no part of the present invention. Suffice it to say that the deck 12 may be adapted to support conventional production processing equipment for oil and gas. Moreover, the deck may support conventional handling equipment, such as a crane, not shown, and may support a helicopter landing pad, also not shown.

The deck 12 is supported above the surface 20 of a body of water by a unique support structure comprising a pile guiding and bracing jacket or tower 22 which includes a substantially vertically extending hollow tubular column member 24 and spaced apart pile guiding sleeves 26, 28, 30 and 32. The sleeves 26, 28, 30 and 32 are suitably aligned with each other and canted at an angle from the vertical at a slope of about one foot of horizontal batter for approximately each seven to twelve feet of vertical run. The sleeves 26 and 28 are interconnected with each other and with the column member 24 by respective lateral braces 34 and 36 and by diagonal braces 38. The braces 34, 36 and 38 are connected to the respective sleeves at so-called "node points" so that a set of braces 34 and 36 are coplanar. A second set of braces 34 and 36 is spaced from the first set and interconnect the sleeve 30 and 32 with each other and with the member 24. The lower set of braces 34 and 36 may be interconnected by suitable gussets or mud mats 46. Moreover, suitable grating or decking 48 may be supported by and between the upper set of braces 34 and 36, respectively.

In the particular installation of the platform 10, the jacket 22 forms lateral support means for elongated piles 50 and 52 which have been driven through the sleeves 26 and 30 and 28 and 32, respectively, and into the sea floor 53 to a sufficient depth so as to be capable of supporting the deck 12 and any structure supported by the deck. The platform 10 also includes a third pile 56 which extends through the column member 24 and is suitably driven into the sea floor. The pile 56 may, in fact, comprise a casing for an oil or gas well, which casing extends to the deck 12 and terminates in a wellhead 58. In the installation illustrated in FIG. 1, the piles 50 and 52 are suitably secured to the guide sleeves, 26 and 28 by welds 60 which may be formed between the piles and the upper transverse edges of the respective guide sleeves once the piles have been driven to their final depth. Welds 61 may also be provided between the guide sleeves 30 and 32 and the respective piles 50 and 52 depending on pile weight and the cost of making welds underwater. Suitable welds, not shown, may also be formed between the piles 50 and 52 and the lower edges of the respective guide sleeves, 26, 28, 30 and 32. In like manner, the casing 56 may also be secured to the column member 24 by a weld 62 or other suitable means. The pile guide sleeves 26, 28, 30 and 32 may be provided with guide funnels, not shown in FIG. 1, which are useful in certain methods of installation of the piles in conjunction with the improved jacket structure 22. The column member 24 may also be provided with suitable funnel entry type guide sleeves 64 and 66 secured to the column member for guiding and laterally supporting a well casing or a pile extending substantially parallel to the column member 24. The platform deck 12 is suitably secured to the piles 50 and 52 by welding the legs 14 and 16 to the respective piles 52 and 50 at welds 65 and 67. The deck 12 may also be secured to the casing type pile 56 in a suitable manner at the deck itself.

The particular installation illustrated in FIG. 1, including the jacket 22, is adapted for installation in water depths of up to about 50 feet above the mudline. For a jacket supporting a platform having approximately 50 tons gross weight, the lateral span between the column member 24 and the guide sleeves 26, 28, 30 and 32 may be approximately 40 feet. The guide sleeves 26, 28, 30 and 32, are preferably approximately 30 inch outside diameter tubular steel sleeves having a nominal wall thickness of about 1.50 inches. The column member 24 is also constructed of the same structural steel tubular material. The lateral braces 34, 36 and 38 are approximately 16.0 inches outside diameter, 0.375 inch wall thickness structural steel.

The overall length of the guide sleeves 26, 28, 30 and 32 are each no more than about ten feet and are preferably about seven feet long. As illustrated in FIG. 1, the platform jacket is dimensioned such that the upper set of guide sleeves 26 and 28 extend above the surface of the water sufficiently that a typical expected wave zone is unlikely to encounter the upper set of lateral braces 34 and 36. Moreover, by eliminating column members which extend the full length of the jacket between the upper and lower sets of braces and for housing the piles 50 and 52, the weight of the jacket is substantially reduced and the expense of manufacturing the jacket is likewise reduced. Although the piles 50 and 52 may be of a heavier design, the overall structure or system will be lighter than prior art jackets.

Referring now to FIGS. 2 through 5, one preferred method of installation of the jacket 22 is illustrated in somewhat schematic form. In the preferred method of installation illustrated in the drawing figures, the piles 50 and 52 are preinstalled through the guide sleeves 26 and 30, and 28 and 32, respectively. The piles 50 and 52 are each temporarily secured to their respective guide sleeves by suitable retaining means such as illustrated in FIG. 6. Referring briefly to FIG. 6, there is illustrated a detail of one method of securing the pile 52 to the guide sleeve 28 temporarily. A plurality of somewhat U-shaped dog members 72 are welded to the outside surface of the sleeve 28 and also to the outside surface of the pile 52. This type of temporary connection is suitable for lifting and handling the piles when preinstalled in the sleeves, together with the jacket structure itself as an integral unit. When the jacket 22 has been set on the sea floor with the piles 50 and 52 already extended through the guide sleeves, the dogs 72 may be removed or at least released from their connection with the piles by flame cutting or the like to free the piles for driving into the sea floor.

Figure 2:
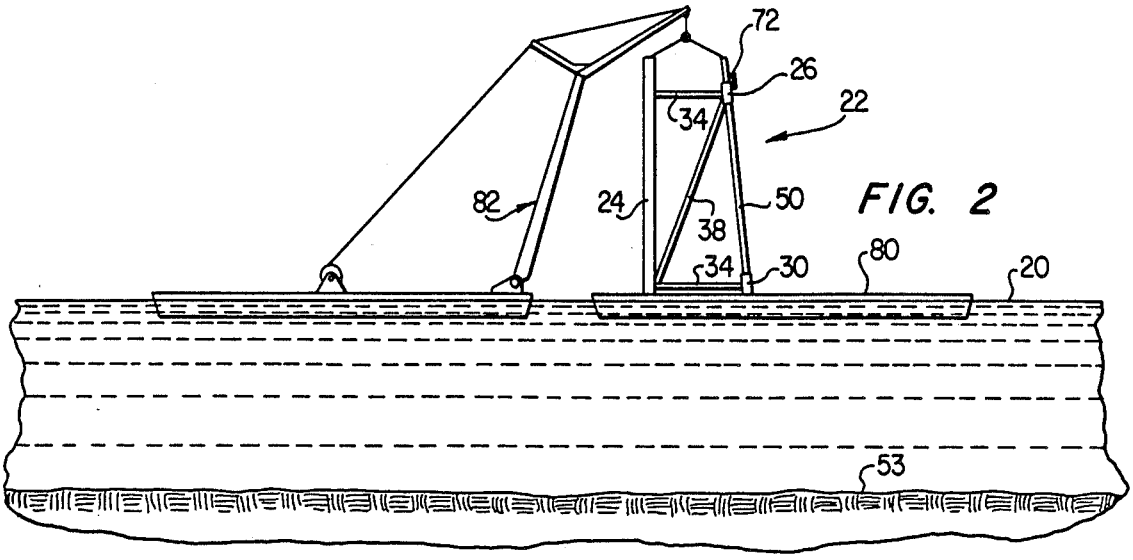
FIG. 2 is a view in somewhat schematic form showing one step in an improved method of installing a platform jacket in accordance with the present invention.
Figure 3:
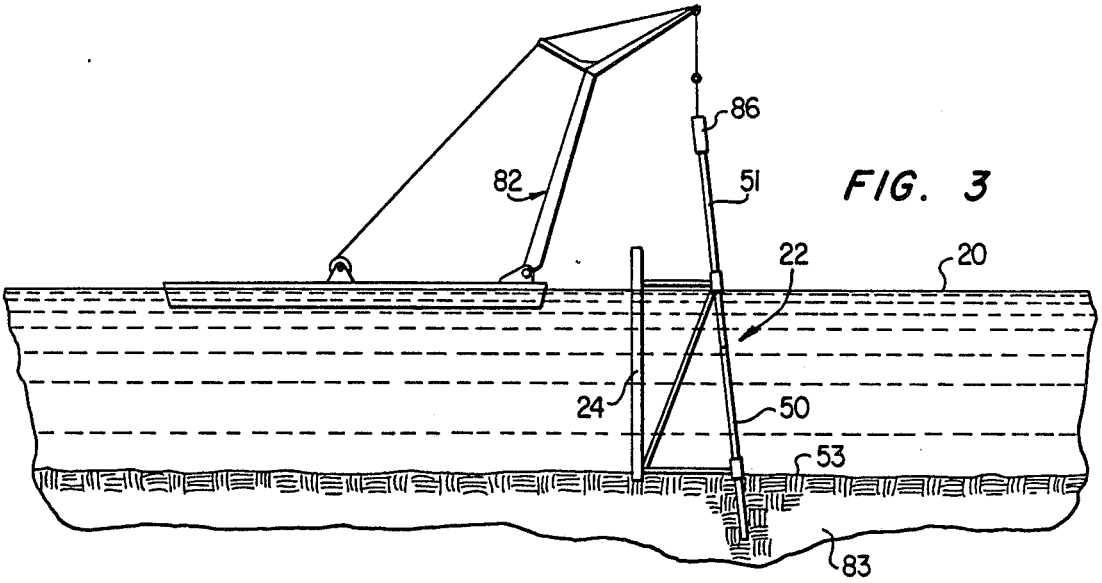
FIG. 3 is a view showing the piling being installed through the jacket guide sleeves.

Referring to FIG. 2, the jacket 22, with the piles 50 and 52 preinstalled in the respective guide sleeves, may be transported to the installation site on a barge 80 and prepared for installation on the sea floor by securing the jacket to a barge mounted crane 82. The crane 82 is then operated to lift the jacket 22 in assembly with the piles 50 and 52 off of the barge 80 while the barge 80 is then moved away and the jacket 22 set down on the sea floor into the position illustrated in FIG. 3. With the jacket 22 in position on the sea floor 53 the dogs 72 are removed and the piles driven into the sea bed 83. Additional piles may be connected seriatum with the piles 50 and 52, such as the pile 51 illustrated secured to the upper end of the pile 50, and driven into the sea floor through the respective sets of sleeves. FIG. 3 illustrates a pile driver 86 suspended from the crane 82 or a similar apparatus, not shown, for driving the pile assembly 50, 51 to refusal or a predetermined depth. Accordingly, each of the piles 50 and 52 may be driven into the sea floor and extension piles such as the pile 51 secured to each of the original piles as required, depending on the total pile depth required. During the operation of pile driving as illustrated in FIG. 3, a pile, not shown, may also be driven through the column member 24 to secure the jacket 22 by a total of three piles. After the piles are driven to final position, welds between the piles and the guide sleeves, such as the welds 60, 61 and 62, shown in FIG. 1, are formed to secure the jacket and pile assembly.

Figure 4:
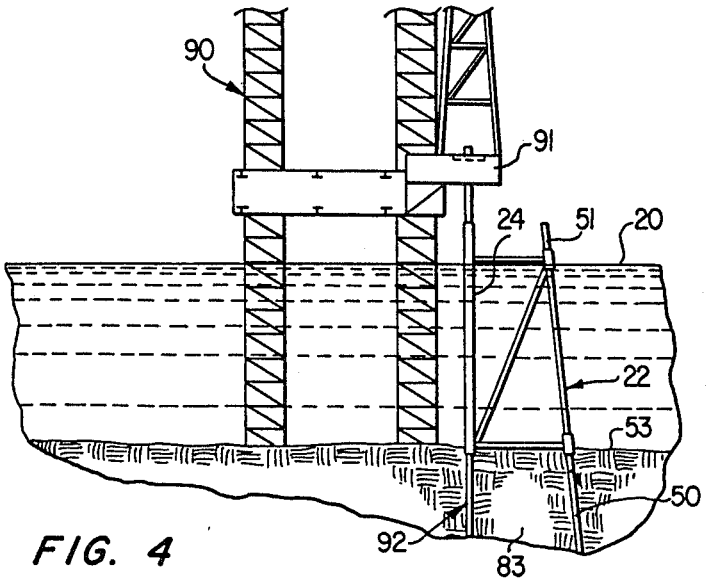
FIG. 4 is a view showing a well being drilled through the column member of the installed jacket.

Further in accordance with one preferred method of installing the jacket 22 and the platform 10, the jacket is also anchored to the sea floor 53 by the well casing 56 which is installed during a drilling operation to drill a well through the column member 24. As illustrated in FIG. 4, after installation of the jacket 22 to the extent illustrated in FIG. 3, the crane 82 is moved off site and a drilling rig 90 is moved into position for drilling a well 92 into the sea bed 83 through the column member 24. The drilling rig 90 is exemplary and is shown as a jack-up type rig with a cantilever derrick and floor assembly 91 arranged such that the drilling rig may move into position over the jacket 22 for performing drilling operations through the column member 24. As part of the drilling operation, the casing 56 is installed in a conventional manner and welded to the column member 24 to further secure the jacket 22 in its working position.

Figure 5:
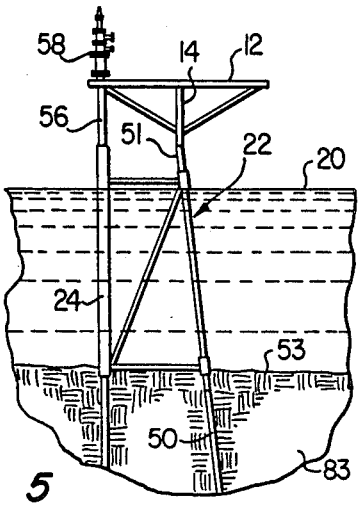
FIG. 5 is a view showing the completed jacket and platform installation.
Figure 6:
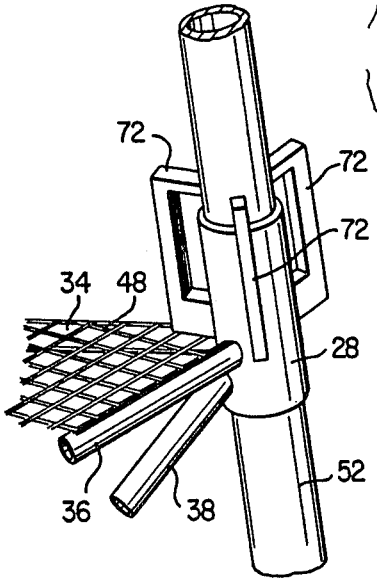
FIG. 6 is a detail view showing one embodiment of a temporary connection between a pile and one of the guide sleeves for use during one method of installing the jacket.

After the drilling operation is complete for the well 92, the rig 90 is moved offsite and a suitable crane barge or the like is moved into position for installing the platform deck 12 whereby the completed installation is obtained, as illustrated in FIG. 5 and also FIG. 1. Alternatively, the jacket 22 may be set in place on the sea floor 53 by the crane 82 without the piles already in the guide sleeves wherein the crane would then hoist and set each pile through its respective set of sleeves prior to a driving operation.

Figure 7:
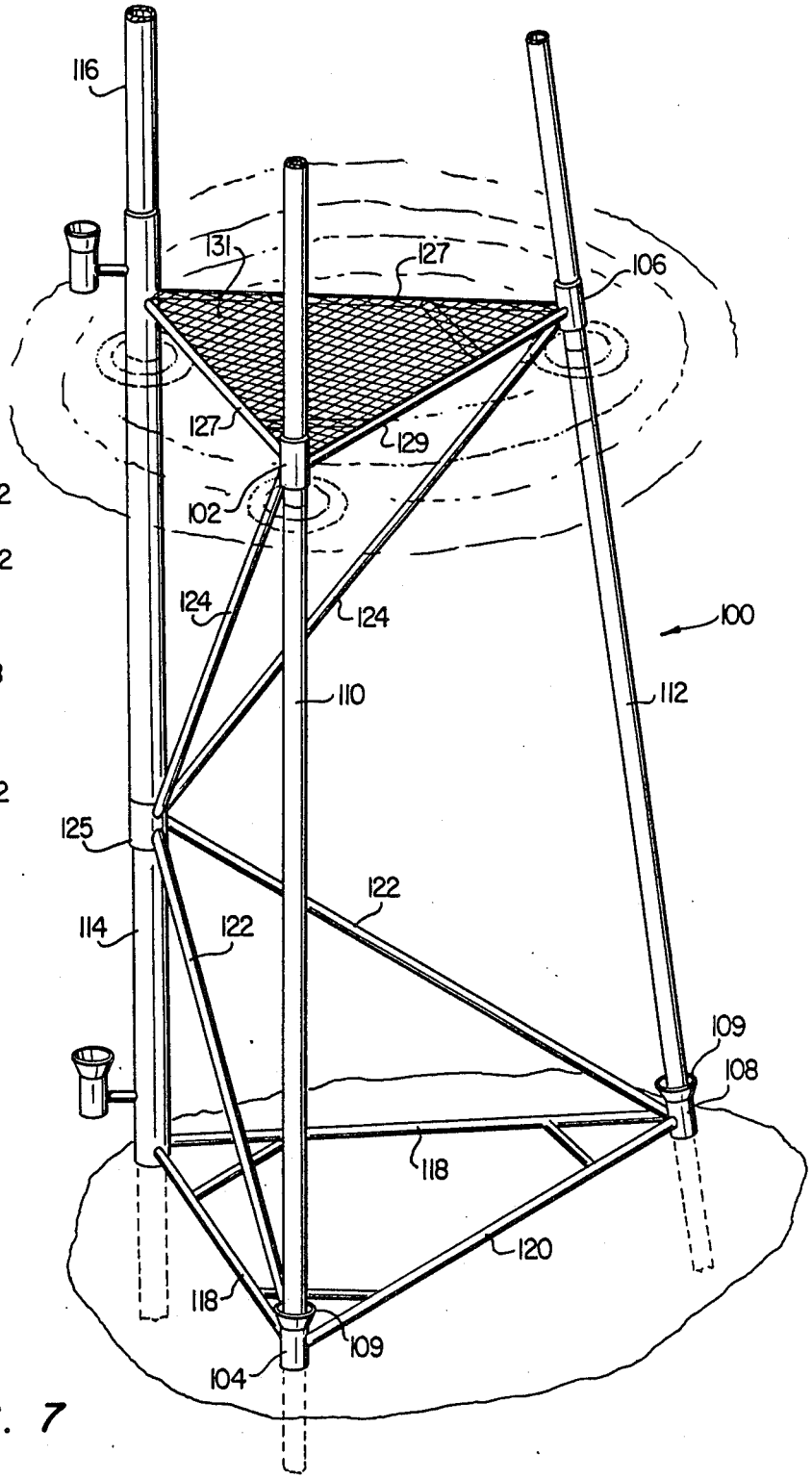
FIG. 7 is a perspective view of a first alternate embodiment of a jacket in accordance with the present invention.

Referring now to FIG. 7, one alternate embodiment of a platform jacket in accordance with the present invention is illustrated and designated by the numeral 100. The platform jacket 100 is adapted for installation in water depths ranging up to about 100 feet and includes spaced apart pile guide sleeves 102, 104, 106 and 108 through which suitable piles 110 and 112 may be driven or preinstalled in the same manner as provided for the jacket 22. Pile entry guide funnels 109 may be provided on the sleeves 104 and 108 if the piles 110 and 112 are not preinstalled. The jacket 100 also includes means forming a vertical column member 114 through which a pile 116 or well casing may be driven after installation of the jacket in its working position on the sea floor.

The jacket 100 includes lateral braces 118 and 120 which are adapted to tie the guide sleeves 104 and 108 together and to the column member 114. The vertical spacing of the guide sleeves 102 and 106 from the guide sleeves 104 and 108 is such that respective sets of diagonal braces 122 and 124 are provided which extend from a common node point 125 to the respective sets of guide sleeves 104 and 108, and 102 and 106. Lateral braces 127 and 129 interconnect the guide sleeves 102 and 106 and support grating 131.

The jacket 100 may be installed in accordance with the method described for the jacket 22 for configurations which are to be installed in water depths up to about 100 feet. Moreover, the pattern of the structure of the guide sleeves, lateral braces, and diagonal braces for the jacket 100 may be repeated for jackets of greater overall height for installation in water depths exceeding 100 feet.

Figure 8:
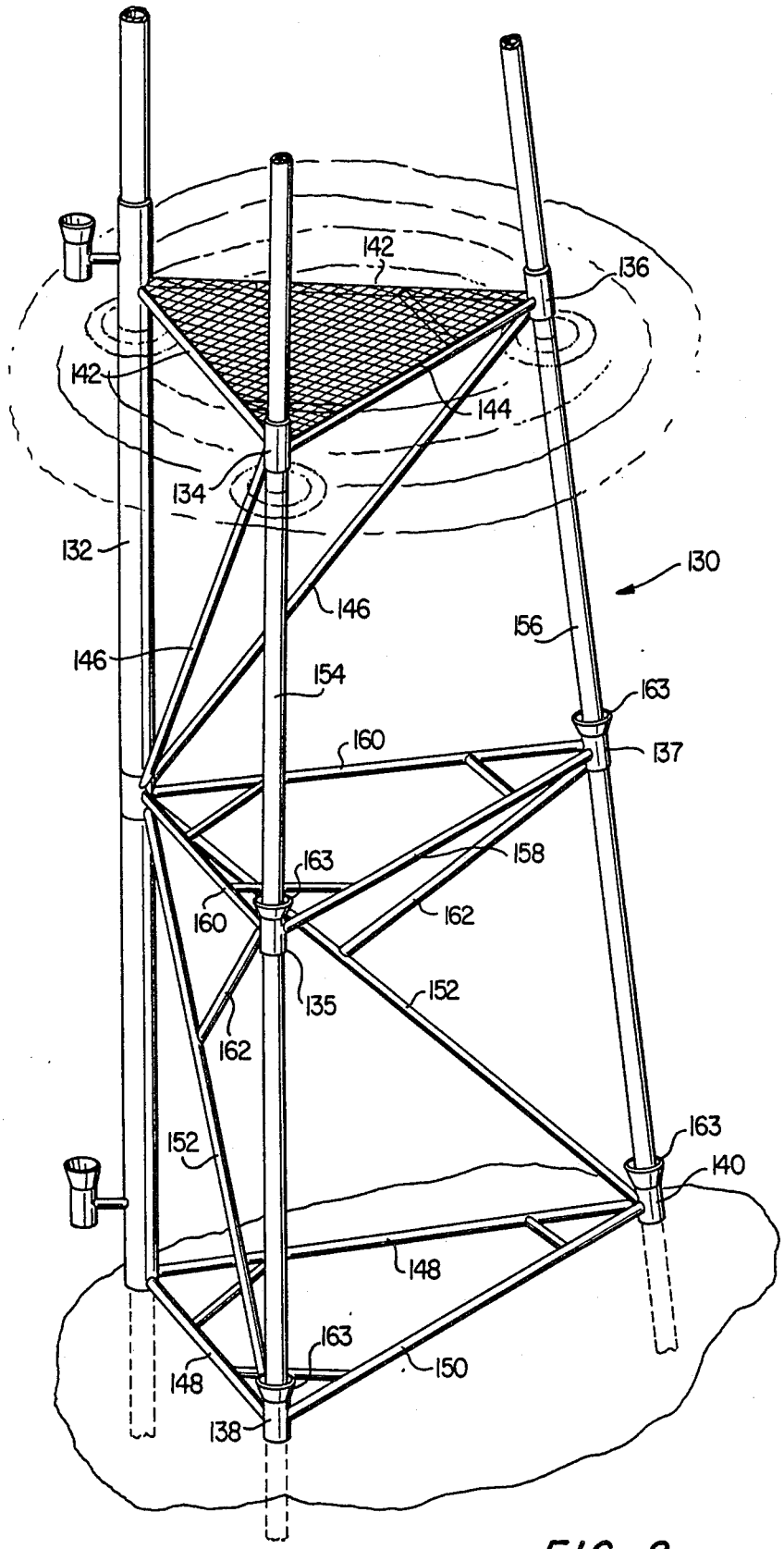
FIG. 8 is a perspective view of a second alternate embodiment of a jacket in accordance with the present invention.

Referring now to FIG. 8, a second alternate embodiment of a platform support jacket in accordance with the present invention is illustrated and generally designated by the numeral 130. The jacket 130 is of a configuration which may be preferred for embodiments which must be installed in water depths greater than 100 feet. The jacket 130 includes means forming a full length substantially vertical column member 132, an upper set of pile guide sleeves 134 and 136 and a lower set of pile guide sleeves 138 and 140. The guide sleeves 134 and 136 are interconnected to each other and to the column member 132 by lateral braces 142 and 144 and diagonal braces 146. The guide sleeves 138 and 140 are interconnected to each other and to the column member 132 by lateral braces 148 and 150 and diagonal braces 152. Due to the substantial span between the upper set of guide sleeves 134 and 136 and the lower set 138 and 140 an intermediate set of guide sleeves 135 and 137. The guide sleeves 135 and 137 are interconnected and their positions strengthened by lateral braces 158 and 160 and diagonal braces 162. The pattern of guide sleeves and braces illustrated for the jacket 130 may also be repeated if the overall length or height of the jacket is to be extended for greater water depths. Both of the jackets 100 and 130 enjoy the advantages of the jacket 22 as set forth herein and their method of installation may be similar in that piles may be preinstalled in the guide sleeves before setting the jacket on the sea floor or after positioning of the jacket. In those instances when the piles are not preinstalled, each of the guide sleeves is provided with a suitable upward facing guide funnel 163, FIG. 8, to facilitate installation of the piling as illustrated.

Although preferred embodiments of an improved offshore platform support jacket and unique methods of installation of same have been described herein, those skilled in the art will recognize that various substitutions and modifications may be made to the specific embodiments shown and described without departing from the scope and spirit of the invention as recited in the appended claims.

What we claim is:

1. A support jacket for supporting a deck of an offshore platform and the like above the surface of a body of water, said jacket comprising:

a single substantially vertically extending hollow column member extending above said surface for receiving means forming a first elongated pile extending through said column member;

a plurality of vertically and laterally spaced guide sleeves connected to said column member only by at least one of diagonal and generally horizontal extending brace means, said guide sleeves being arranged to receive and guide respective second and third elongated piles and for laterally bracing said second and third piles for supporting said deck above said jacket, said guide sleeves including a first pair of laterally spaced part guide sleeves disposed generally adjacent one end of said column member and a second pair of said guide sleeves laterally spaced apart and adjacent the other end of said column member, each pair of said guide sleeves being interconnected to said column member by said brace means, said guide sleeves extending generally vertically only a short distance from points of connection with said brace means to minimize the weight of said jacket and reduce fores imposed on said jacket due to wave action, and selected ones of said guide sleeves being adapted to be secured to said second and third piles, respectively.

2. The jacket set forth in claim 1 wherein:

said column member includes means forming spaced apart guide sleeves for guiding at least one of a well casing and a pile for securing said jacket in position for supporting said deck.

3. The jacket set forth in claim 1 including:

guide funnel means disposed on selected ones of said guide sleeves at the upper ends thereof, respectively, for guiding a pile during installation thereof through said guide sleeves, respectively.

4. The jacket set forth in claim 1 including:

at least one pair of guide sleeves intermediate an upper pair of guide sleeves and a lower pair of guide sleeves for stabilizing said piles.

5. An offshore platform and supporting jacket for oil and gas operations comprising:

a platform jacket disposed substantially above the sea floor, said jacket including a single generally vertical tubular column member, means forming a first elongated pile extending through said column member and into said sea floor and secured to said column member at least two spaced apart guide sleeves disposed laterally spaced from each other and from said column member adjacent an upper end of said column member and interconnected to said column member only by at least one of substantially lateral and diagonal extending bracing, and at least a pair of lower guide sleeves disposed laterally spaced apart form each other and from said column member adjacent a lower end of said column member and also interconnected to said column member only by at least one of substantially lateral and diagonal extending bracing;

elongated second and third pies extending through said upper guide sleeves and said lower guide sleeves, respectively, and into said sea floor, each of said second and third piles being secured to at least one of said guide sleeves, respectively; and a platform deck supported on and above said piles.

6. The platform set forth in claim 5 wherein:

said first pile comprises a well casing extending to a wellhead on said platform deck.

7. The platform set forth in claim 5 including:

support mat means secured to said lateral bracing of said lower guide sleeves for supporting said jacket during installation thereof on the sea floor.

8. The platform set forth in claim 5 wherein:

said jacket and at least two piles are preassembled and temporarily secured to each other by extending said piles through respective sets of said guide sleeves and securing said piles to said guide sleeves for movement between a point of assembly of said piles with said jacket and the place of installation of said jacket on the sea floor.

9. A method for installing an offshore jacket for supporting a platform deck and the like with respect to the sea floor comprising:

providing a piling support jacket comprising at least one generally vertically extending tubular column member and at least a pair of guide sleeves laterally spaced apart from each other and from said column member and interconnected to said column member by bracing means;

said guide sleeves being positioned such as to extend above the sea surface when said jacket is installed on said sea floor;

providing at least a pair of elongated piles extending through said guide sleeves and at least temporarily secured to said guide sleeves, respectively;

transporting said jacket in assembly with said piles to a point of installation on the sea floor and setting said jacket in assembly with said piles on said sea floor;

disconnecting said piles from said jacket to the extent that said piles may be driven through said guide sleeves into the sea floor;

driving said piles into the sea floor;

securing said piles to respective ones of said guide sleeves;

positioning a drilling rig over said column member and drilling a well through said column member including installing casing means through said column member; and securing said casing means to said column member.

10. The method set forth in claim 9 wherein:

the step of securing said piles to said guide sleeves includes welding said piles to said guide sleeves, respectively.

11. The method set forth in claim 9 wherein:

the step of securing said casing means to said column member comprises welding said casing means to said column member.

* * * * *

UNITED STATES PATENT AND TRADEMARK OFFICE

CERTIFICATE OF CORRECTION

PATENT NO. : 4,812,080

DATED : March 14, 1989

INVENTOR(S) : Richard G. Urquhart and Adel S. Tawfik

It is certified that error appears in the above-identified patent and that said Letters Patent is hereby corrected as shown below:

Column 6, line 66, delete "fores" and insert --- forces ---.

Column 7, line 40, delete "pies" and insert --- piles ---.

Signed and Sealed this

Nineteenth Day of September, 1989

*Attest:*

*Attesting Officer*

DONALD J. QUIGG

*Commissioner of Patents and Trademarks*